US007652455B2

(12) United States Patent
Demolli

(10) Patent No.: US 7,652,455 B2
(45) Date of Patent: Jan. 26, 2010

(54) LOW-DROPOUT VOLTAGE REGULATOR WITH A VOLTAGE SLEW RATE EFFICIENT TRANSIENT RESPONSE BOOST CIRCUIT

(75) Inventor: Frederic Demolli, Rognac (FR)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 11/708,725

(22) Filed: Feb. 20, 2007

(65) Prior Publication Data

US 2007/0241728 A1 Oct. 18, 2007

Related U.S. Application Data

(63) Continuation of application No. 11/406,172, filed on Apr. 18, 2006, now Pat. No. 7,199,565.

(51) Int. Cl.
*G05F 1/40* (2006.01)
*G05F 1/44* (2006.01)
*G05F 1/56* (2006.01)

(52) U.S. Cl. ..... 323/274; 323/273; 323/270; 323/275; 323/279

(58) Field of Classification Search ..... 323/273, 323/274, 270, 275, 279
See application file for complete search history.

(56) References Cited

U.S. PATENT DOCUMENTS 4,008,418 A 2/1977 Murphy
4,543,522 A 9/1985 Moreau
5,130,635 A 7/1992 Kase
5,629,609 A 5/1997 Nguyen et al.
5,686,820 A 11/1997 Riggio, Jr.
5,847,551 A 12/1998 Arora et al.
5,864,227 A * 1/1999 Borden et al. ..... 323/280

(Continued)

FOREIGN PATENT DOCUMENTS

WO WO-2007120906 A2 10/2007

(Continued)

OTHER PUBLICATIONS

"A Low-Voltage, Low Quiescent Current, Low Drop-Out Regulator" by Gabriel A. Rincon-Mora et al., IEEE Journal of Solid-State Circuits, vol. 33, No. 1, pp. 36-44, Jan. 1998.

(Continued)

*Primary Examiner*—Bao Q Vu
(74) *Attorney, Agent, or Firm*—Schwegman, Lundberg & Woessner P.A.

(57) ABSTRACT

A low-dropout (LDO) voltage regulator for generating an output voltage is disclosed. The voltage regulator includes a startup circuit, a curvature corrected bandgap circuit, an error amplifier, a metal oxide semiconductor (MOS) pass device and a voltage slew rate efficient transient response boost circuit. The MOS pass device has a gate node which is coupled to the output of the error amplifier, and a drain node for generating the output voltage. The voltage slew rate efficient transient response boost circuit applies a voltage to the gate node of the MOS pass device to accelerate the response time of the error amplifier in enabling the LDO voltage regulator to reach its final regulated output voltage when an output voltage drop occurs in the LDO voltage regulator.

23 Claims, 5 Drawing Sheets

U.S. PATENT DOCUMENTS

| | | | | |
|---|---|---|---|---|
| 5,952,817 | A * | 9/1999 | Brewster et al. | 323/268 |
| 5,966,004 | A * | 10/1999 | Kadanka | 323/271 |
| 6,046,577 | A * | 4/2000 | Rincon-Mora et al. | 323/282 |
| 6,188,211 | B1 * | 2/2001 | Rincon-Mora et al. | 323/280 |
| 6,188,212 | B1 | 2/2001 | Larson et al. | |
| 6,201,375 | B1 * | 3/2001 | Larson et al. | 323/277 |
| 6,333,623 | B1 * | 12/2001 | Heisley et al. | 323/280 |
| 6,373,233 | B2 | 4/2002 | Bakker et al. | |
| 6,377,033 | B2 * | 4/2002 | Hsu | 323/274 |
| 6,469,480 | B2 | 10/2002 | Kanakubo | |
| 6,501,252 | B2 * | 12/2002 | Fujise | 323/274 |
| 6,501,305 | B2 * | 12/2002 | Rincon-Mora et al. | 327/108 |
| 6,518,737 | B1 | 2/2003 | Stanescu et al. | |
| 6,522,111 | B2 * | 2/2003 | Zadeh et al. | 323/277 |
| 6,522,114 | B1 * | 2/2003 | Bakker et al. | 323/282 |
| 6,650,093 | B1 * | 11/2003 | Baldwin et al. | 323/224 |
| 6,710,583 | B2 | 3/2004 | Stanescu et al. | |
| 6,897,637 | B2 | 5/2005 | Chen et al. | |
| 7,135,912 | B2 * | 11/2006 | Perez | 327/541 |
| 7,199,565 | B1 | 4/2007 | Demolli | |
| 2003/0111985 | A1 | 6/2003 | Xi | |
| 2003/0111987 | A1 | 6/2003 | Chen et al. | |
| 2004/0021503 | A1 | 2/2004 | Hulfachor et al. | |
| 2005/0189930 | A1 | 9/2005 | Wu et al. | |
| 2006/0273771 | A1 | 12/2006 | van Ettinger et al. | |
| 2007/0146020 | A1 | 6/2007 | Williams | |
| 2008/0054867 | A1 | 3/2008 | Soude | |

FOREIGN PATENT DOCUMENTS

| | | | |
|---|---|---|---|
| WO | WO-2007120906 | A3 | 10/2007 |

OTHER PUBLICATIONS

"LTC1272: Single-Supply, Sampling 12-Bit ADC Guarantees 3-Microsecond Conversions" by William Rempfer, Linear Technology Magazine, vol. 1, No. 2, pp. 1-20, Oct. 1991.

U.S. Appl. No. 11/516,535, Notice of Allowance mailed Mar. 31, 2009, 6 pgs.

U.S. Appl. No. 11/516,535 Final Office Action mailed Dec. 15, 2008, 11 pgs.

U.S. Appl. No. 11/516,535 Non-Final Office Action mailed May 15, 2008, 14 pgs.

U.S. Appl. No. 11/516,535 Response filed Sep. 15, 2008 to Non-Final Office Action mailed May 15, 2008, 9 pgs.

U.S. Appl. No. 11/516,535, Response filed Mar. 16, 2008 to Final Office Action mailed Dec. 15, 2008, 8 pgs.

US 7,567,068, 07/2009, Demolli (withdrawn)

* cited by examiner

LOW-DROPOUT VOLTAGE REGULATOR WITH A VOLTAGE SLEW RATE EFFICIENT TRANSIENT RESPONSE BOOST CIRCUIT

CROSS REFERENCE TO RELATED APPLICATIONS

This application is a continuation of U.S. patent application Ser. No. 11/406,172, filed Apr. 18, 2006, which issued as U.S. Pat. No. 7,199,565 on Apr. 3, 2007 and is incorporated by reference as if fully set forth.

FIELD OF INVENTION

The present invention is related to voltage regulation circuits. More particularly, the present invention is related to a voltage regulator that uses semiconductor devices to provide generally fixed output voltages over varying loads with minimal voltage dropout on the output.

BACKGROUND

Low-dropout (LDO) voltage regulators have gained popularity with the growth of battery-powered equipment. Portable electronic equipment including cellular telephones, pagers, laptop computers and a variety of handheld electronic devices has increased the need for efficient voltage regulation to prolong battery life. LDO voltage regulators are typically packaged as an integrated circuit (IC) to provide generally fixed output voltages over varying loads with minimal voltage dropout on the output in a battery-powered device. Furthermore, performance of LDO voltage regulators is optimized by taking into consideration standby and quiescent current flow, and stability of the output voltage.

FIG. 1 is a schematic diagram of a conventional LDO voltage regulator 100 including a startup circuit 105, a curvature corrected bandgap circuit 110, an error amplifier 115, a metal oxide semiconductor (MOS) pass device 120, (e.g., a positive channel MOS (PMOS) pass device, a negative channel MOS (NMOS) pass device), resistors 125, 130, and a decoupling capacitor 135 having a capacitance COUT. The LDO voltage regulator 100 outputs an output voltage, $V_{out}$, 145.

The curvature corrected bandgap circuit 110 is electrically coupled to the startup circuit 105 and the error amplifier 115. The startup circuit 105 provides the curvature corrected bandgap circuit 110 with current when no current is flowing through the LDO voltage regulator 100 during a supply increase or startup phase until the bandgap voltage is high enough to allow the curvature corrected bandgap circuit 110 to be self-sustaining. The curvature corrected bandgap circuit 110 generates a reference voltage 152 which is input to a positive input 150 of the error amplifier 115, and a reference current 154 which is input to a reference current input 158 of the error amplifier 115. Generally, the reference current 154 is a proportional to absolute temperature (PTAT) current generated by the curvature corrected bandgap circuit 110.

The error amplifier 115 includes a positive input 150 coupled to the curvature corrected bandgap circuit 110 for receiving the reference voltage 152, a reference current input 158 for receiving the reference current 154, a negative input 155, and an amplifier output 160.

The MOS pass device 120 includes a gate node 165, a source node 170 and a drain node 175. The MOS pass device 120 may be either a PMOS or an NMOS pass device. The gate node 165 of the MOS pass device 120 is coupled to the amplifier output 160 of the error amplifier 115. The source node 170 of the MOS pass device 120 is coupled to a supply voltage, $V_s$. The drain node 175 of the MOS pass device 120 generates the output voltage, $V_{out}$, 145 of the LDO voltage regulator 100. The resistors 125 and 130 are connected in series to form a resistor bridge. One end of the resistor 125 is coupled to the drain node 175 of the MOS pass device 120 and the other end of the resistor 125 is coupled to both the negative input 155 of the error amplifier 115 and one end of the resistor 130. Thus an error correction loop 180 is formed. The other end of resistor 130 is coupled to ground. The decoupling capacitor 135 is coupled between $V_{out}$ and ground.

In the conventional LDO voltage regulator 100, a capacitance CMOS associated with the gate node 165 of the MOS pass device 120 and the decoupling capacitor 135 cause the slew rate and bandwidth of the error amplifier 115 to be limited. The conventional LDO voltage regulator 100 provides a fixed output voltage, but is constrained by others specifications such as voltage drop, gain and transient response. When a current step occurs, (due to the load of a circuit coupled to the output voltage, $V_{out}$, 145), the output voltage, $V_{out}$, 145 decreases first and, after an error correction loop delay Tfb occurs, the gate node 165 of the MOS pass device 120 is adjusted by the error amplifier 115 to provide the requested output current.

FIG. 2 shows a graphical representation of the output voltage, $V_{out}$, 145 of the conventional LDO voltage regulator 100 shown in FIG. 1 during a maximum current step required by the load of a circuit coupled to the voltage output, $V_{out}$, 145. The delay Tfb corresponds to the minimum error correction loop delay to ensure voltage regulation. This delay is proportional to the bandwidth of the error amplifier 115 and may be calculated in accordance with the following Equation (1):

$$Tfb = \frac{1}{fu}; \qquad \text{Equation (1)}$$

where Tfb is the delay and fu is the unity gain frequency of the error amplifier 115.

The voltage drop during this delay may be approximated in accordance with the following Equation (2):

$$\delta V = \frac{I_{max}}{C_{out}} Tfb \qquad \text{Equation (2)}$$

where δV is the voltage drop, $I_{max}$ is the maximum output current required by the load of a circuit coupled to the voltage output, $V_{out}$, 145, $C_{out}$ is the capacitance of the decoupling capacitor 135 and Tfb is the error correction loop delay.

Referring to FIGS. 1 and 2, the error correction loop 180 provides voltage regulation after the Tfb delay and modifies the voltage of the gate node 165 of the MOS pass device 120 in order to switch on the MOS pass device 120. The output voltage, $V_{out}$, 145 is adjusted until the full load regulated value is reached. The time needed to recover the final value, $T_{reg}$, may be approximated in accordance with the following Equation (3):

$$T_{reg} = \frac{C_{OUT}}{I_{pass} - I_{max}} \times V_{drop} \qquad \text{Equation (3)}$$

where $C_{out}$ is the capacitance of the decoupling capacitor 135, $I_{pass}$ is the current of the MOS pass device 120, $I_{max}$ is the maximum output current required by the load of a circuit coupled to the voltage output, $V_{out}$, 145, and $V_{drop}$ is the maximum voltage drop.

After $T_{reg}$, the voltage of the gate node 165 of the PMOS pass device 120, $V_{gsmax}$, provides sufficient current through the PMOS pass device 120 to ensure output voltage stability. However, a significant voltage drop and a delay in reaching the final regulated output voltage occurs.

It would be desirable to modify the LDO voltage regulator 100 of FIG. 1 such that it is able to more rapidly set the voltage of the gate node 165 of the PMOS pass device 120 to the $V_{gsmax}$ voltage (or lower) in order to reduce output voltage drops and delays in reaching the final regulated output voltage, $V_{out}$, 145.

SUMMARY

The present invention is related to an LDO voltage regulator for generating an output voltage. The voltage regulator includes a startup circuit, a curvature corrected bandgap circuit, an error amplifier, a MOS pass device and a voltage slew rate efficient transient response boost circuit. The MOS pass device has a gate node which is coupled to the output of the error amplifier, and a drain node for generating the output voltage. The voltage slew rate efficient transient response boost circuit applies a voltage to the gate node of the MOS pass device to accelerate the response time of the error amplifier in enabling the LDO voltage regulator to reach its final regulated output voltage when an output voltage drop occurs in the LDO voltage regulator.

BRIEF DESCRIPTION OF THE DRAWINGS

A more detailed understanding of the invention may be had from the following description, given by way of example and to be understood in conjunction with the accompanying drawings wherein.

DETAILED DESCRIPTION OF THE INVENTION

The present invention is incorporated in a novel voltage regulator which provides a simple solution to increase voltage regulator performance while reducing output voltage drop. This solution includes a voltage slew rate efficient transient response boost circuit that is configured in accordance with the present invention. The present invention can also be applied to any known voltage regulator structure by incorporating a voltage slew rate efficient transient response boost circuit which provides a simple solution to increase voltage regulator performance.

In one embodiment, the gate node of a PMOS pass device is rapidly set to the $V_{gsmax}$ voltage (or lower) in order to avoid voltage drops and to reduce delays between the output current step and the final regulated output voltage. When the output voltage falls below a predefined threshold, the gate node of the MOS pass device is coupled to $V_{gsmax}$ (or lower).

Figure 3:
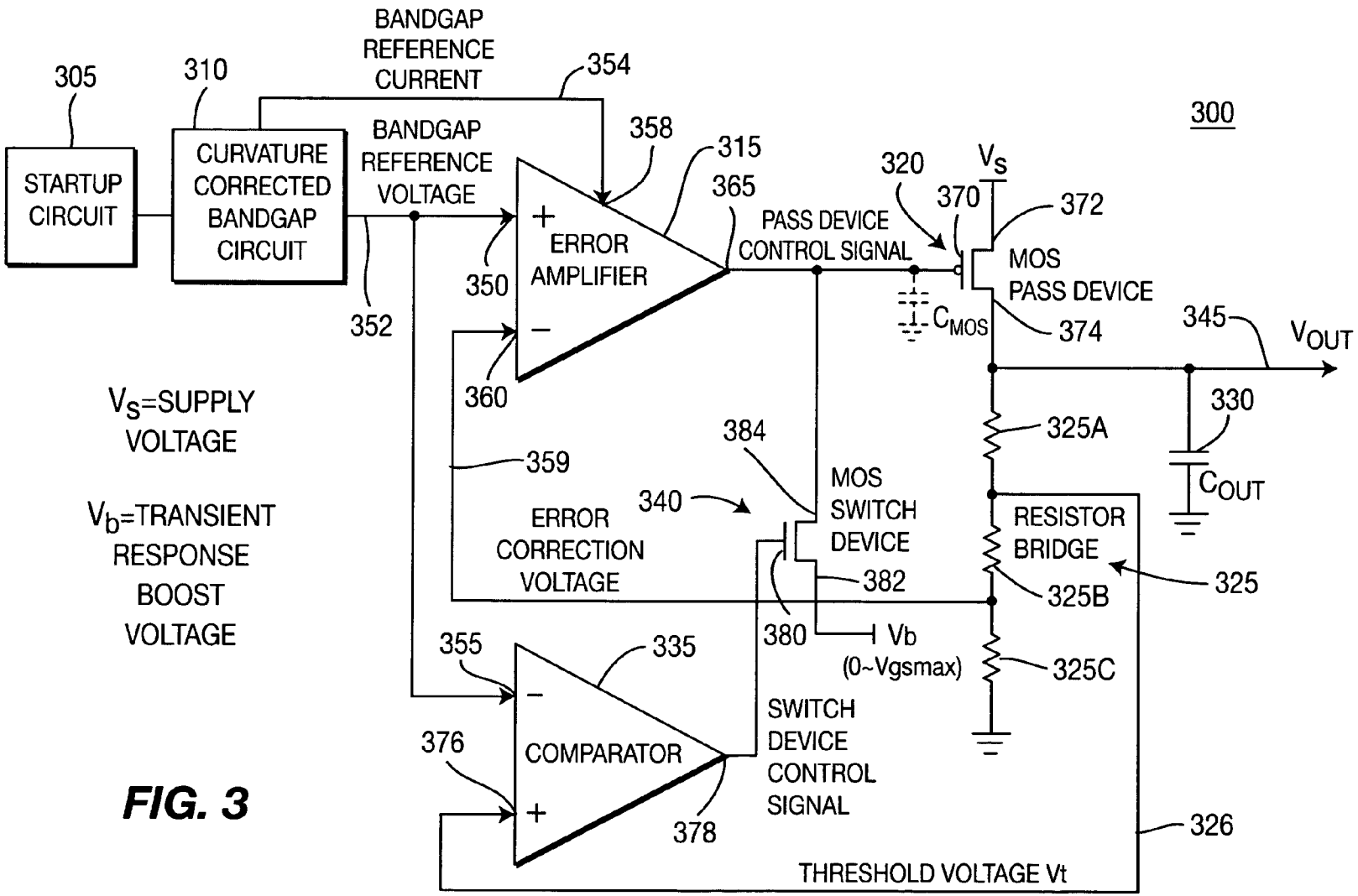
FIG. 3 is a schematic diagram of an LDO voltage regulator with a voltage slew rate efficient transient response boost circuit configured in accordance with the present invention.

Referring now to FIG. 3, a schematic diagram of an LDO voltage regulator 300 configured in accordance with the present invention is shown. The LDO voltage regulator 300 includes a startup circuit 305, a curvature corrected bandgap circuit 310, an error amplifier 315, a MOS pass device 320, a resistor bridge 325 including resistors 325A, 325B, 325C, a decoupling capacitor 330 having a capacitance $C_{out}$, a comparator 335 and a MOS switch device 340. The LDO voltage regulator 300 generates an output voltage, $V_{out}$, 345. The resistor bridge 325, the comparator 335 and the MOS switch device 340 form a slew rate efficient transient response boost circuit. The MOS pass device 320 may be either a PMOS or an NMOS pass device. The MOS switch device 340 may be either a PMOS or an NMOS switch device.

The curvature corrected bandgap circuit 310 is electrically coupled to the startup circuit 305 and the error amplifier 315. The startup circuit 305 provides the curvature corrected bandgap circuit 310 with current when no current is flowing through the LDO voltage regulator 300 during a supply increase or startup phase until the bandgap voltage is high enough to allow the curvature corrected bandgap circuit 310 to be self-sustaining. The curvature corrected bandgap circuit 310 generates a bandgap reference voltage 352 which is input to a positive input 350 of the error amplifier 315 and a negative input 355 of the comparator 335. The curvature corrected bandgap circuit 310 also generates a reference current 354 which is input to a reference current input 358 of the error amplifier 315. Generally, the reference current 354 is a PTAT current generated by the curvature corrected bandgap circuit 310.

The error amplifier 315 includes a positive input 350 coupled to the curvature corrected bandgap circuit 310 for receiving the bandgap reference voltage 352, a reference current input 358 for receiving the bandgap reference current 354, a negative input 360 for receiving an error correction voltage 359 from the resistor bridge 325, and an amplifier output 365.

The MOS pass device 320 includes a gate node 370, a source node 372 and a drain node 374. The gate node 370 of the MOS pass device 320 is coupled to the amplifier output 365, which outputs a pass device control signal. The source node 372 of the MOS pass device 320 is coupled to a supply voltage, $V_s$. The drain node 374 of the MOS pass device 320 generates the output voltage, $V_{out}$, 345 of the LDO voltage regulator 300. The resistors 325A, 325B, 325C are connected in series to form a resistor bridge 325. One end of the resistor 325A is coupled to the drain node 374 of the MOS pass device 320 and the other end of the resistor 325A is coupled to both a positive input 376 of the comparator 335 and one end of the resistor 325B. The other end of the resistor 325B is coupled to the negative input 360 of the error amplifier 315 and to one end of the resistor 325C. The other end of the resistor 325C is coupled to ground. The decoupling capacitor 330 is coupled between $V_{out}$ 345 and ground.

Still referring to FIG. 3, the MOS switch device 340 includes a gate node 380, a source node 382 and a drain node 384. An output 378 of the comparator 335 is coupled to the gate node 380 of the MOS switch device 340. The output 378 generates a switch device control signal. The drain node 384 is coupled to the output 365 of the error amplifier 315 and the gate node of the MOS pass device 320. The source node 382 of the MOS switch device 340 is coupled to a transient response boost voltage, Vb, which may be generated, for example, by an output current monitoring unit coupled to the voltage output, $V_{out}$, 345.

The positive input 376 of the comparator 335 receives a threshold voltage, Vt, 326 from the junction between the resistors 325A and 325B. The value of Vt may be calculated in accordance with the following Equation (4):

$$Vt = V_{out} - \left(V_{drop} - \frac{I_{max}}{C_{out}} \times \tau_{de}\right) \quad \text{Equation (4)}$$

where Vt is the threshold voltage of the comparator 335, $V_{out}$ is the regulated output voltage, $V_{drop}$ is the maximum voltage drop allowed, $I_{max}$ is the maximum output current, $C_{out}$ is the value of the decoupling capacitor 330 and $\tau_{de}$ is the internal delay of the comparator 335.

The MOS switch device 340 is a small and fast device having a drain node 384 coupled to the gate node 370 of the MOS pass device 320 and coupled to a transient response boost voltage, Vb, that is set to a "final value" between zero volts, (i.e., a ground value), and a maximum voltage, $V_{gsmax}$. The purpose of the MOS switch device 340 is to rapidly set a final value on the gate node 370 of the MOS pass device 320 in order to permit the MOS pass device 320 to deliver the maximum output current to $V_{out}$ 145.

Figure 1:
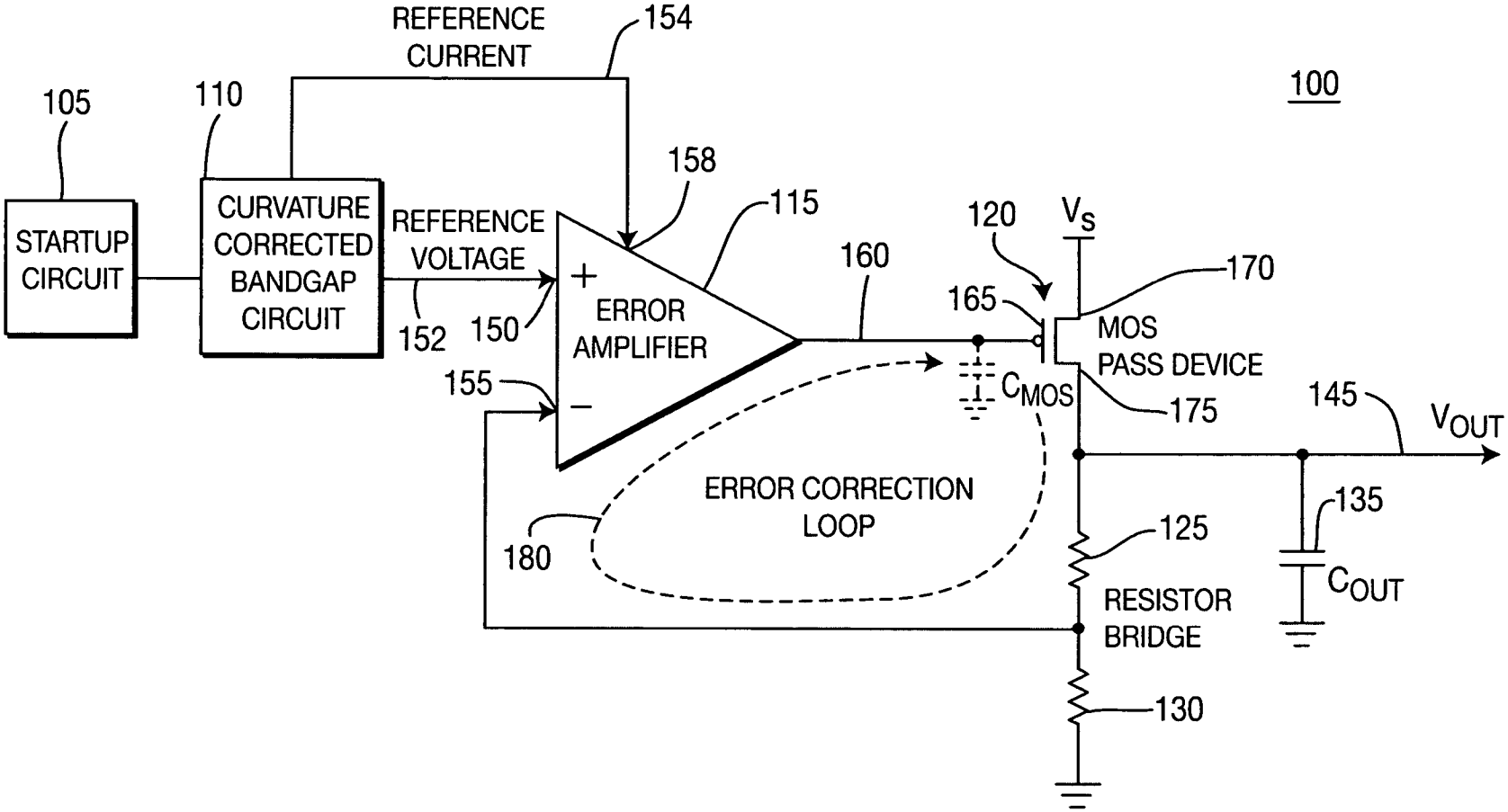
FIG. 1 PRIOR ART
FIG. 1 is a schematic diagram of a conventional LDO voltage regulator.
Figure 2:
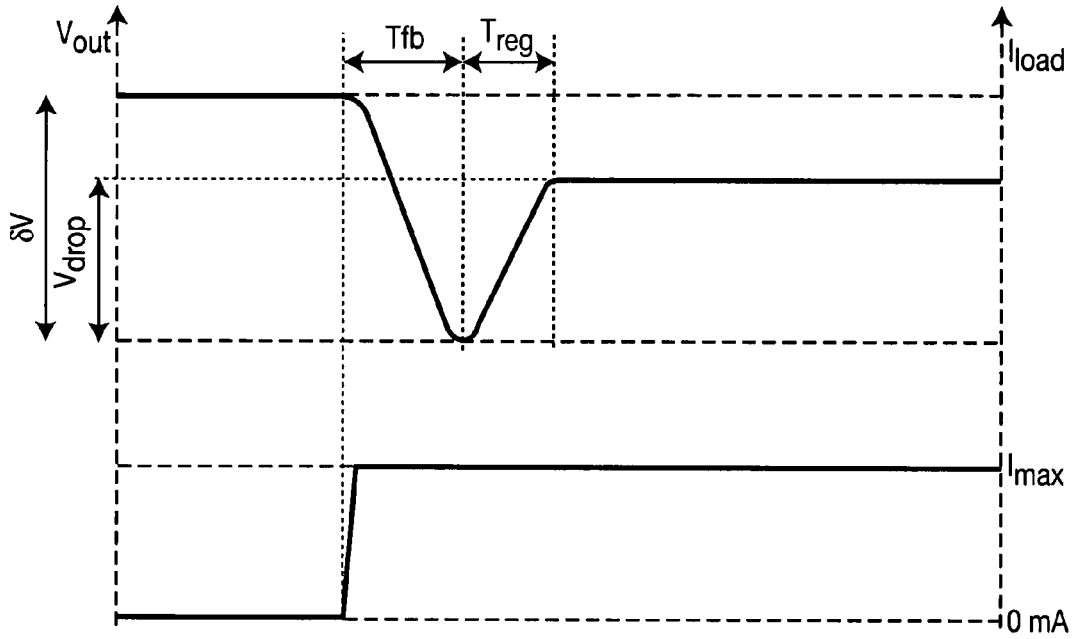
FIG. 2 PRIOR ART
FIG. 2 is a graphical representation of the output voltage transient response to a maximum output current step in the conventional LDO voltage regulator of FIG. 1.
Figure 4:
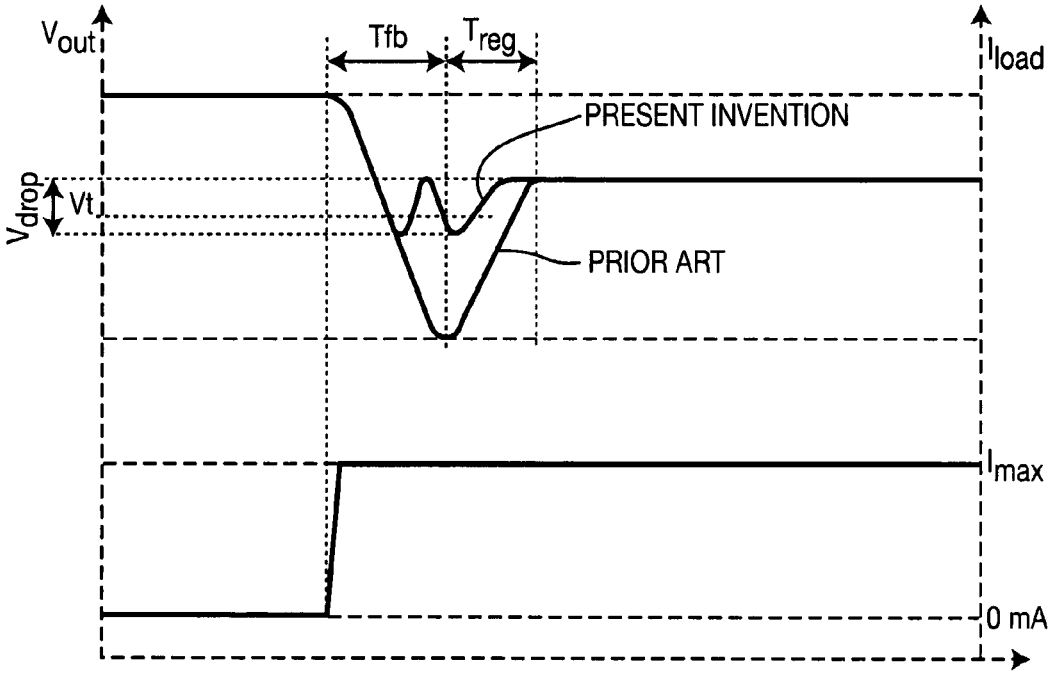
FIG. 4 is a graphical representation of the output voltage transient response of the LDO voltage regulator of FIG. 3 when a transient response boost voltage, Vb, is set to zero volts (ground)

As shown in FIG. 4, the output voltage transient response of the present invention has the same error correction loop delay Tfb as that in the transient response of the conventional LDO voltage regulator 100 shown in FIG. 1. By switching the MOS switch device 340 on, Vb is set to a ground value which results in a high output current and a fast output voltage rising edge. The comparator 335 then switches off the NMOS switch device 340 until the next voltage drop. The output 378 of the comparator 335 is either zero volts, (i.e., a ground value), which turns off the MOS switch device 340, or $V_s$ which turns on the MOS switch device 340. During this time, some oscillations may be present due to the multiple comparator switching but the maximum voltage drop is reduced. After the error correction loop delay Tfb, the error correction voltage 359 is provided by the resistor bridge 325 to the negative input 360 of the error amplifier 315, which provides output voltage regulation and adjusts the output voltage on the gate node 370 of the MOS pass device 320 to the final value.

Figure 5:
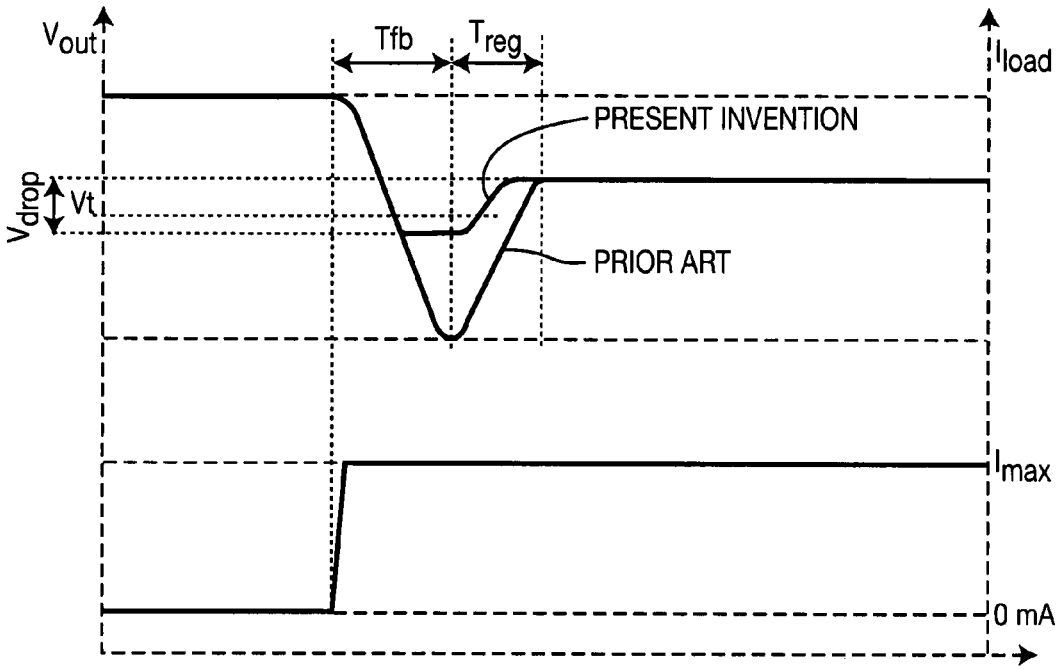
FIG. 5 is a graphical representation of the output voltage transient response of the LDO voltage regulator of FIG. 3 when Vb is set to $V_{gsmax}$.

In another embodiment, the transient response boost voltage, Vb, is set exactly to $V_{gsmax}$. The comparator 335 switches on the MOS switch device 340, thus coupling the gate node 370 of the MOS pass device 320 to $V_{gsmax}$, whereby the output current is exactly the same as the load current. Thus, output voltage, $V_{out}$, 345 is immediately regulated, as shown in FIG. 5. When the voltage drop exceeds Vt, the gate node 370 of the PMOS pass device 320 is immediately coupled to its final value and then the LDO voltage regulator 300 is set to a full load regulated voltage mode. By setting the voltage of the gate node 370 of the MOS pass device using the MOS switch device 340, instead of waiting for the error amplifier 325 to do it, the error amplifier response time is increased and the voltage output 345 is regulated and the voltage drop of $V_{out}$ 345 is greatly reduced.

Figure 6:
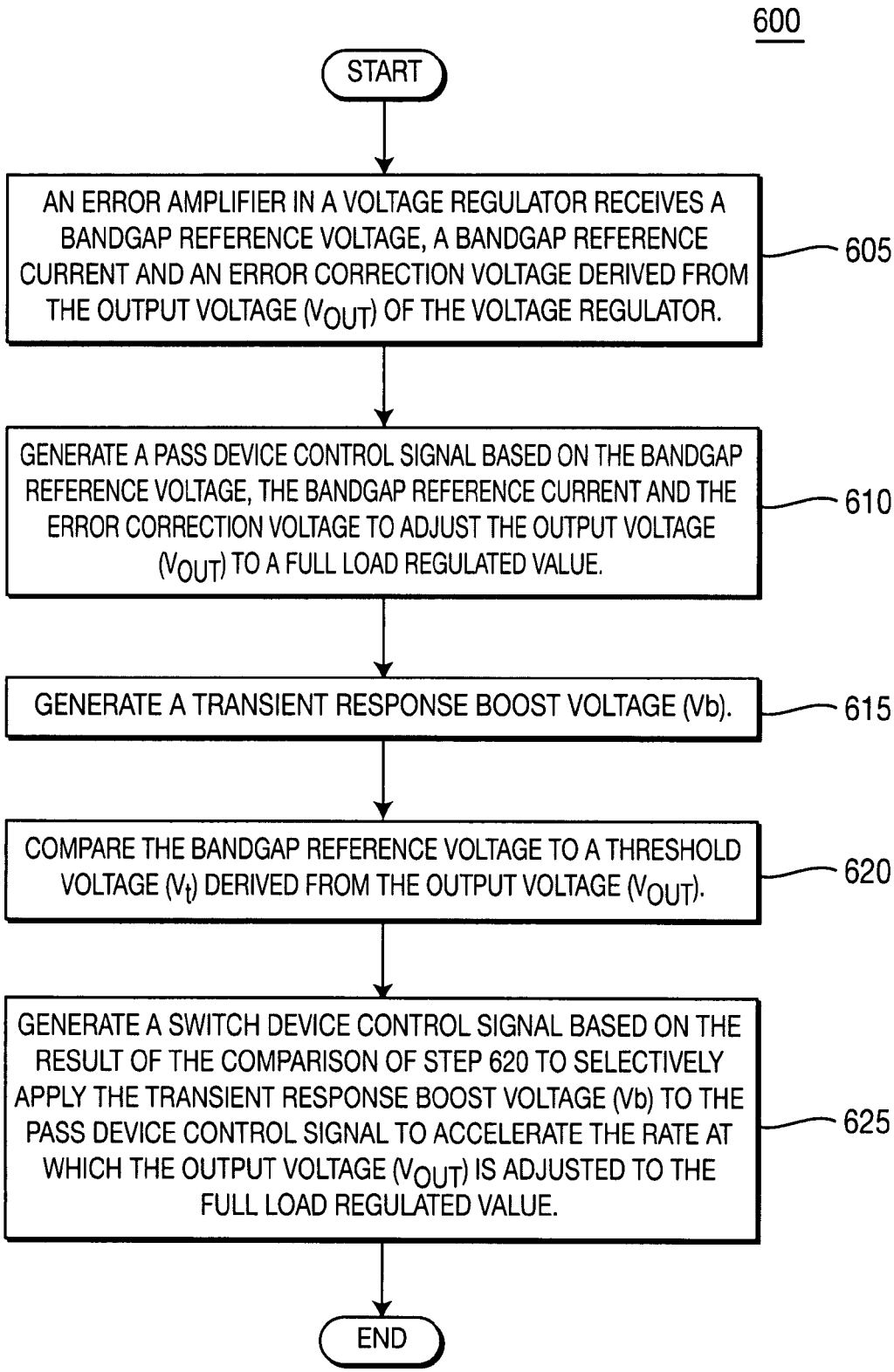
FIG. 6 is a flow diagram of a process of regulating an output voltage implemented by the LDO voltage regulator of FIG. 3.

In accordance with the present invention, a process 600 of regulating an output voltage, $V_{out}$, 345 is implemented using the LDO voltage regulator 300. Referring to FIGS. 3 and 6, a bandgap reference voltage 352 is received at the positive input 350 of the error amplifier 315, a bandgap reference current 354 is received at the reference current input 358 of the error amplifier 315, and an error correction voltage 359 derived from the output voltage, $V_{out}$, 345 is received at the negative input 360 of the error amplifier 315 (step 605). The error amplifier 315 generates a pass device control signal which closes the pass device 320 based on the bandgap reference voltage 352, the bandgap reference current 354 and the error correction voltage 359 to adjust the output voltage, $V_{out}$, 345 to a full load regulated value (step 610). In step 615, the transient response boost voltage, Vb, is generated. In step 620, the bandgap reference voltage 352 is compared by the comparator 335 to a threshold voltage, Vt, 326 derived from the output voltage, $V_{out}$, 345. The comparator 335 generates a switch device control signal which closes the switch device 340 based on the comparison of step 620 to selectively apply the transient response boost voltage, Vb, to the pass device control signal to accelerate the rate at which the output voltage, $V_{out}$, 345 is adjusted to the full load regulated value (step 625). The transient response boost voltage, Vb, is applied to the pass device control signal when a drop in the output voltage, $V_{out}$, 345 occurs.

Although the features and elements of the present invention are described in particular combinations, each feature or element can be used alone without the other features and elements of the embodiments or in various combinations with or without other features and elements of the present invention.

What is claimed is:

1. A voltage regulator comprising:

an amplifier having an amplifier output;

a pass device having a first node coupled to the amplifier output for generating an output voltage via a second node of the pass device; and a voltage control circuit for applying a voltage to the first node to accelerate a response time of the amplifier in enabling the output voltage to reach its final regulated output voltage, the voltage control circuit comprising a comparator having a negative input coupled to a positive input of the amplifier, and a switch device having a first switch node coupled to an output of the comparator, a second switch node coupled to an additional voltage, and a third switch node coupled to the amplifier output and the first node of the pass device to apply the additional voltage to the first node of the pass device.

2. The voltage regulator of claim 1 wherein the pass device is a positive channel metal oxide semiconductor (PMOS) pass device, the first node is a gate node and the second node is a drain node.

3. The voltage regulator of claim 1 wherein the pass device is a negative channel metal oxide semiconductor (NMOS) pass device, the first node is a gate node and the second node is a drain node.

4. The voltage regulator of claim 1 wherein the voltage control circuit further comprises:

a resistor bridge including a first resistor, a second resistor and a third resistor connected in series, the first resistor having a first end coupled to the second node of the pass device, wherein a positive input of the comparator is connected to a second end of the first resistor and a first end of the second resistor.

5. The voltage regulator of claim 4 wherein a second end of the second resistor and a first end of the third resistor are coupled to a negative input of the amplifier, and a second end of the third resistor is coupled to ground.

6. The voltage regulator of claim 1 further comprising:

a startup circuit; and a curvature corrected bandgap circuit coupled to the startup circuit-for inputting a reference voltage to the positive input of the amplifier and the negative input of the comparator, and inputting a reference current to a reference current input of the amplifier.

7. The voltage regulator of claim 6 wherein the comparator is configured to turn the switch device on and off based on voltages at the negative input and a positive input of the comparator.

8. The voltage regulator of claim 7 wherein the curvature corrected bandgap circuit and the resistor bridge are configured to provide the voltages.

9. A voltage regulator comprising:

a pass device having an output node for generating an output voltage;

an amplifier having an amplifier output coupled to an input node of the pass device; and a voltage control circuit coupled to the amplifier output and the input node of the pass device, wherein the voltage control circuit is configured to apply a voltage to the input node of the pass device to accelerate a response time of the amplifier in enabling the output voltage to reach its final regulated output voltage, and the voltage control circuit comprises a comparator having a negative input that is coupled to a positive input of the amplifier, and a switch device having a first switch node coupled to an output of the comparator, a second switch node coupled to an additional voltage, and a third switch device node coupled to the amplifier output and the first node of the pass device to apply the additional voltage to the first node of the pass device.

10. The voltage regulator of claim 9 wherein the pass device is a positive channel metal oxide semiconductor (PMOS) pass device, the input node is a gate node and the output node is a drain node.

11. The voltage regulator of claim 9 wherein the pass device is a negative channel metal oxide semiconductor (NMOS) pass device, the input node is a gate node and the output node is a drain node.

12. The voltage regulator of claim 9 wherein the voltage control circuit further comprises:

a resistor bridge including a first resistor, a second resistor and a third resistor connected in series, the first resistor having a first end coupled to the output node of the pass device positive input of the comparator is connected to a second end of the first resistor and a first end of the second resistor.

13. The voltage regulator of claim 12 wherein a second end of the second resistor and a first end of the third resistor are coupled to a negative input of the amplifier, and a second end of the third resistor is coupled to ground.

14. The voltage regulator of claim 12 further comprising:

a startup circuit; and a curvature corrected bandgap circuit coupled to the startup circuit for inputting a reference voltage to the positive input of the amplifier and the negative input of the comparator, and inputting a reference current to a reference current input of the amplifier.

15. The voltage regulator of claim 14 wherein the comparator is configured to turn the switch device on and off based on voltages at the negative and positive inputs of the comparator.

16. The voltage regulator of claim 15 wherein the curvature corrected bandgap circuit and the resistor bridge are configured to provide the voltages.

17. A method comprising:

generating a first control signal to control a gate of a transistor to adjust an output voltage to a full load regulated value;

generating a transient response boost voltage, wherein the first control signal controls a pass device to deliver a maximum output current associated with the output voltage; and selectively applying the transient response boost voltage to the gate of the transistor to accelerate the rate at which the output voltage is adjusted to the full load regulated value.

18. The method of claim 17 further comprises:

comparing a bandgap reference voltage to a threshold voltage derived from the output voltage to produce a comparison result; and generating a second control signal based on the comparison result.

19. A voltage regulator comprising:

an amplifier having an amplifier output;

a first transistor having a gate coupled to the amplifier output for generating an output voltage via a node the first transistor;

a comparator having an input coupled to an input of the amplifier, and an a comparator output; and a second transistor having a gate responsive to the comparator output to couple the gate of the first transistor to a voltage.

20. The voltage regulator of claim 19 further comprising a resistor bridge coupled between a ground potential and the node of the first transistor.

21. The voltage regulator of claim 20, wherein the resistor bridge includes a resistor having a first end coupled to an additional input of the amplifier and a second end coupled to an additional input of the comparator.

22. The method of claim 17 wherein a value of the transient response boost voltage includes zero.

23. The method of claim 17 wherein a value of the transient response boost voltage is set between zero and a gate-to-source voltage of a transistor.

* * * * *